US006337538B1

(12) United States Patent
Awaji et al.

(10) Patent No.: US 6,337,538 B1
(45) **Date of Patent: *Jan. 8, 2002**

(54) PLASMA DISPLAY PANEL HAVING DIELECTRIC LAYER WITH MATERIAL OF BUS ELECTRODE

(75) Inventors: Noriyuki Awaji; Shinji Tadaki, both of Akashi; Keiichi Betsui, Kobe, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/236,581

(22) Filed: Jan. 26, 1999

(30) Foreign Application Priority Data

Jun. 25, 1998 (JP) ..... 10-196800

(51) Int. Cl.[7] ..... H01J 17/49

(52) U.S. Cl. ..... 313/586; 313/582

(58) Field of Search ..... 313/582, 586, 313/587

(56) References Cited

U.S. PATENT DOCUMENTS 4,109,176 A * 8/1978 Ernsthausen et al. ..... 313/587
5,793,158 A 8/1998 Wedding, Sr.

FOREIGN PATENT DOCUMENTS

| | | |
|---|---|---|
| EP | 0 788 131 | 8/1997 |
| JP | 5-165042 | 6/1993 |
| JP | 7-282979 | 10/1995 |

OTHER PUBLICATIONS

Patent Abstracts of Japan, vol. 098, No. 009, Jul. 31, 1998 and JP 10 112265 A (Matsushita Electric Ind Co Ltd), Apr. 28, 1998.

Patent Abstracts of Japan, vol. 018, No. 623 (E–1635), Nov. 28, 1994 and JP 06 243788 A (Hokuriku Toryo KK), Sep. 2, 1994.

Japanese Laid Open Patent No. 5–165042, of the Patent Abstract of Japan, Jun. 29, 1993.

Japanese Laid Open Patent No. 10–112265, respectively of the Patent Abstract of Japan and "Scope of Patent Claim" in English and Japanese, Apr. 28, 1998.

* cited by examiner

*Primary Examiner*—Vip Patel
(74) *Attorney, Agent, or Firm*—Staas & Halsey LLP

(57) ABSTRACT

Local losses of material of transparent electrodes, in a plasma display panel including transparent electrodes, bus electrodes and, a dielectric layer covering these electrodes, are prevented by using a plasma display panel according to the present invention. The plasma display panel is formed on at least one substrate of a pair of substrates provided opposite each other via a discharge space. An element, which is a main element of the bus electrode composition, is included in the composition of the dielectric layer. Since the main element of the bus electrode is included in the dielectric layer, local losses of the transparent electrode can be prevented even through the high temperature baking process of the dielectric layer. A preferred choice as the main element of the bus electrode composition is copper, but other elements are also suitable and will perform acceptably.

20 Claims, 5 Drawing Sheets

PLASMA DISPLAY PANEL HAVING DIELECTRIC LAYER WITH MATERIAL OF BUS ELECTRODE

CROSS REFERENCE TO RELATED APPLICATIONS

This application is based upon and claims priority from Japanese Patent Application No. 10-196800 filed Jun. 25, 1998, the contents of which are incorporated herein by reference.

BACKGROUND OF THE INVENTION

1. Field of the Invention

The present invention relates to a plasma display panel and a method of manufacturing the same and, more particularly, to a composition of a dielectric layer of such a plasma display panel that covers both transparent and bus electrodes thereof.

2. Description of the Related Art

A plasma display panel ("PDP") is attracting attention in the field of displays as a full-color display apparatus having a large size display area. Particularly, an AC type PDP of a 3-electrode surface discharge model has a structure in which a plurality of display electrode pairs for generating surface discharges are formed on a substrate on the display surface thereof and are then covered with a dielectric layer; address electrodes, orthogonal to the display electrodes, and a phosphor layer covering the address electrodes are formed on the substrate on the rear surface thereof. An image to be displayed is written in the form of wall charges while discharge is sequentially generated between the display electrodes and the address electrodes with one display electrode used as a manipulating electrode. Thereafter, a sustaining voltage is impressed across the display electrode pairs to generate a sustaining discharge. This is the basic operation of known PDP's.

A full-color display can be realized when the phosphor layers of three primary colors are energized by the ultraviolet rays generated by the sustaining discharge and emit the corresponding fluorescent colors of RGB (red, green, blue). Therefore, for the emission of color from the phosphor layer on the substrate on the rear surface side, a transparent electrode material is formed on the substrate on the display electrode pairs. Moreover, a display electrode structure of a transparent electrode with a metal bus electrode formed thereon is generally employed to afford a reduced resistance value of the display electrode.

The transparent electrode material is a semiconductor typically formed of ITO (e.g., a mixture of indium oxide $In_2O_3$ and tin oxide $SnO_2$). The conductivity of the transparent electrode is low in comparison with that of metal. Therefore, a fine metal conductive layer is added as the metal bus electrode on the transparent electrode to enhance its conductivity.

A dielectric layer covering the transparent electrodes and the bus electrodes is traditionally formed by depositing a low melting point glass paste layer on the substrate and then baking it under a high temperature, for example, 600° C. Such a high temperature baking presents a problem in that the transparent electrode is reduced in thickness or even is lost, i.e., disappears, altogether. This occurs because a battery effect is generated between the transparent and bus electrodes due to the difference in the ionization tendency between the materials of the stacked transparent and bus electrodes. If the transparent electrode becomes thinner or is lost altogether, the sustaining discharge voltage between the display electrodes of each pair rises and, as a result, achieving a stable drive of the PDP becomes difficult. The present inventors have proposed in Japanese Patent Application No. Hei 9-038932 that a rise of the resistance value of the transparent electrode can be controlled by mixing a transparent electrode material with the dielectric material. However, the mixture of the transparent electrode material cannot solve the problem of the loss of the transparent electrode by the battery effect between the transparent electrode and bus electrode, thus leaving unsolved the problem that a local transparent electrode is lost.

The reason why the transparent electrode is lost is not always apparent, but it can be assumed that the oxidation-reduction reaction, based on the battery effect between the transparent electrode and bus electrode, is generated when the dielectric layer is baked under a high temperature, causing the transparent electrode material to dissolve into the dielectric layer.

SUMMARY OF THE INVENTION

Therefore, considering the problem discussed above, it is an object of the present invention to provide a plasma display panel and a method of manufacturing the same which can prevent local disappearance of the transparent electrode.

Moreover, it is another object of the present invention to provide a plasma display panel and a method of manufacturing the same that controls a sustaining discharge voltage to a lower value by reducing a resistance of the transparent electrode.

To attain the objects explained above, the present invention proposes a plasma display panel comprising transparent electrodes, bus electrodes and a dielectric layer covering these electrodes on at least one substrate of a pair of substrates positioned in opposed relationship to each other via a discharge space, wherein a main element of the composition of the bus electrode is included in the composition of the dielectric material.

Moreover, the present invention is also characterized in that the bus electrode is mainly composed of copper oxide, which is also included in the dielectric layer. Local losses of the transparent electrode seem to be prevented, even after undergoing the high temperature process because the main element of the bus electrode is included in the dielectric material.

BRIEF DESCRIPTION OF THE DRAWINGS

These and other objects, features, and characteristics of the present invention will become clear to those skilled in the art from a study of the following detailed description in combination with the attached drawings and appended claims, all of which form a part of this specification. In the drawings:

DETAILED DESCRIPTION OF THE PRESENTLY PREFERRED EXEMPLARY EMBODIMENT

A preferred embodiment of the present invention will be explained with reference to the accompanying drawings. However, the preferred embodiment is not meant to limit the scope of the claimed invention.

Figure 1:
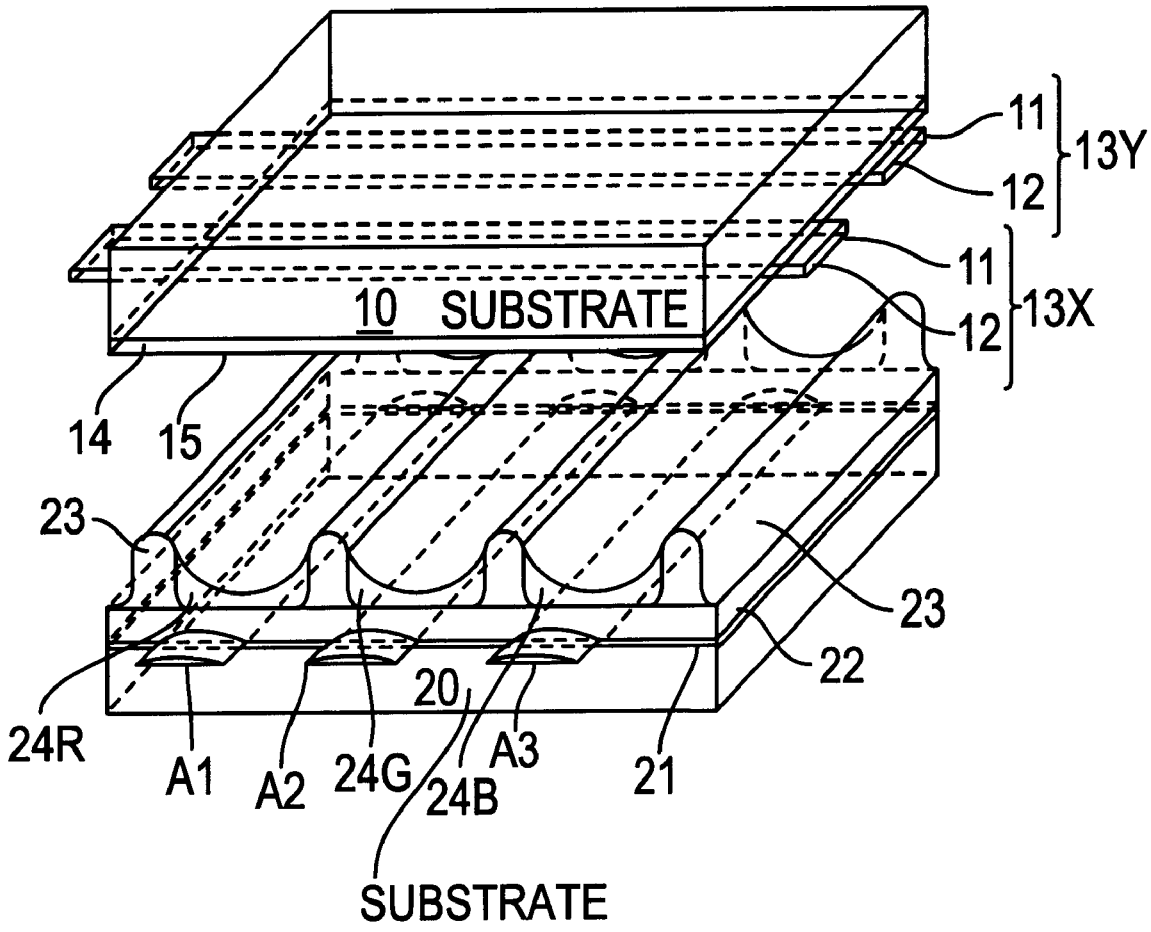
FIG. 1 is an exploded perspective view of a PDP in accordance with a preferred embodiment of the present invention.
Figure 2:
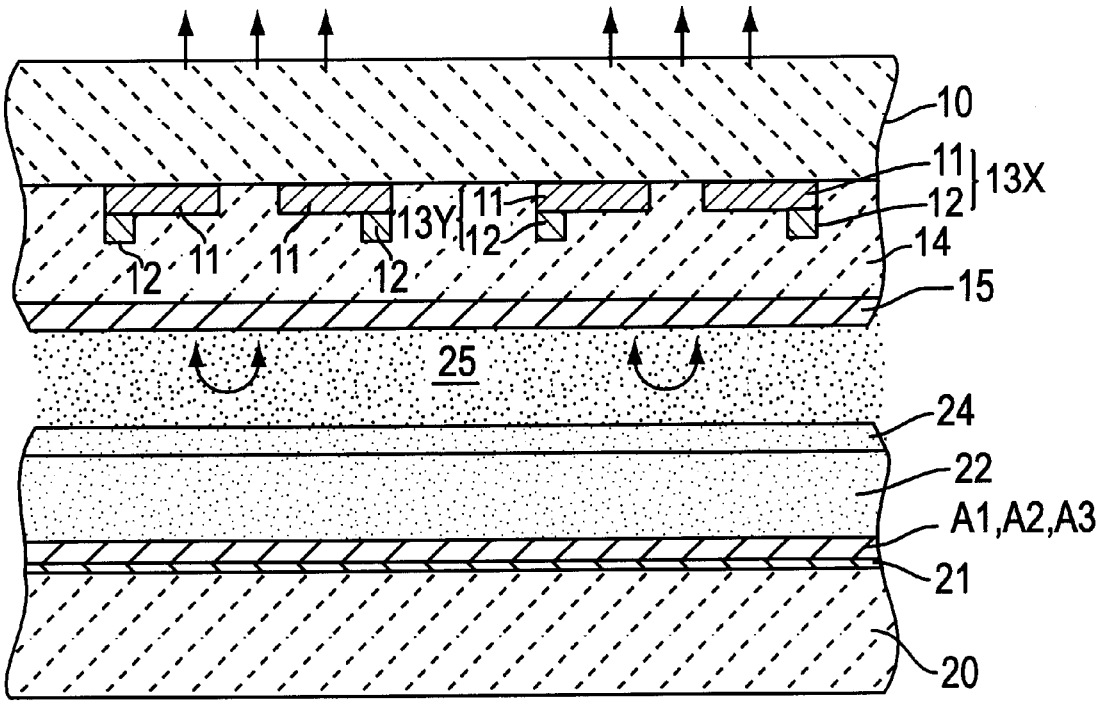
FIG. 2 is cross-sectional view of the PDP shown in FIG. 1.

FIG. 1 is a disassembled perspective view of the AC type PDP of the 3-electrode surface discharge model as the preferred embodiment of the present invention. Moreover, FIG. 2 shows a cross-sectional view of such a PDP. With reference to both figures, the structure of such a PDP will be explained. In this example, the display beam is emitted in the direction of the glass substrate 10 of the display side (direction shown by arrows in FIG. 2). Numeral 20 designates a glass substrate on the rear surface side. On the glass substrate 10 of the display side, X electrode 13X and Y electrode 13Y, including the highly conductive bus electrode 12 formed on the transparent electrode 11, are formed and these electrode pairs, i.e., electrodes 13X and 13Y, are covered with a dielectric layer 14 and a protection layer 15 consisting of MgO. The bus electrode 12 is provided along the end part of the transparent electrode at opposite sides thereof on each of the X electrode and Y electrode in order to compensate for conductivity of the transparent electrode 11.

The bus electrode 12 is, for example, a metal electrode having a three-layer structure of chromium-copper-chromium. Moreover, the transparent electrode 11 is usually formed of ITO (Indium Tin Oxide, mixture of indium oxide, $In_2O_3$, and tin oxide, $SnO_2$) with the addition of the bus electrode 12 assuring sufficient conductivity. In some cases, the transparent electrode is formed of a tin oxide film (nesa film). In addition, the dielectric layer 14 is formed of a low melting point glass material mainly composed of lead oxide. In more detail, the glass materials are of the PbO—$SiO_2$—$B_2O_3$—ZnO group or PbO—$SiO_2$—$B_2O_3$—ZnO—BaO group.

On the rear surface of glass substrate 20, striped address electrodes A1, A2, A3 are provided on the lower layer passivation film 21, for example, including a silicon oxide film. These address electrodes are covered with the dielectric layer 22. Moreover, these address electrodes A1–A3 are respectively located between the striped separation walls (ribs) 23 formed respectively on the substrate 20. The separation walls 23 function to isolate discharge cells in the display electrode direction and to prevent crosstalk of light. For each adjacent rib 23, the phosphors of red, green and blue 24R, 24G, 24B are respectively, separately coated to cover the address electrodes and the rib wall surface.

Moreover, as shown in FIG. 2, the display side substrate 10 and rear surface side substrate 20 are combined while maintaining a gap 25 therebetween of about 100 $\mu$m. This gap 25 is filled with a discharge gas mixture of Ne+Xe.

Figure 3:
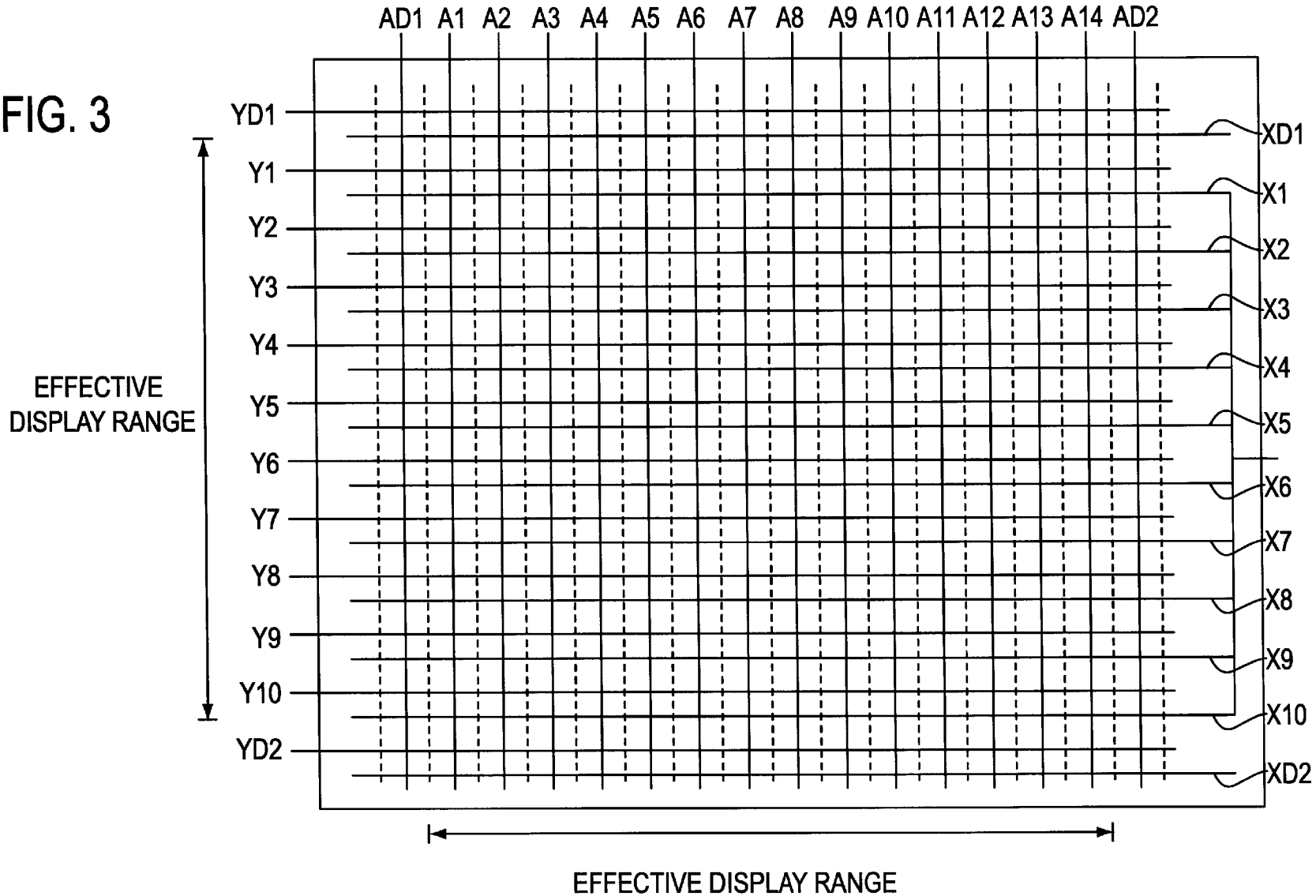
FIG. 3 is a plan view of the panel showing a relationship between the X and Y electrodes and the address electrode of the 3-electrode surface discharge type PDP.

FIG. 3 is a plan view of a panel indicating the relationship between the X, Y electrodes and the address electrodes of the 3-electrode surface discharge type PDP. The X electrodes X1 to X10 are arranged in parallel in the lateral direction and are connected to a common voltage source in the end part of the substrate, while the Y electrodes Y1 to Y10 are respectively provided between the X electrodes. These X, Y electrodes are respectively paired to form a display line and the sustaining discharge voltage for display is alternately impressed across these X and Y electrode pairs. XD1, XD2 and YD1, YD2 are dummy electrodes provided at the external side of the effective display area to alleviate the characteristic of nonlinearity of the peripheral part of the panel. The address electrodes A1 to A14 provided on the rear surface of the substrate 20 are orthogonal to the X and Y electrodes.

The X and Y electrodes are paired and the sustaining discharge voltage is alternately applied to these electrodes. Each address electrode is used to write information which generates a plasma discharge for the address between each address electrode and the Y electrode that is being scanned in accordance with the informtion.

When the sustaining discharge voltage is impressed on the display electrode, a voltage caused by the charges accumulated by the address discharge is added on the surface (that is, on the surface of protection layer 15) of the dielectric layer 14 to generate a sustaining plasma discharge. Ultraviolet beams generated by the plasma discharge are radiated to the phosphor layer 22 to generate respective colors. The generated light beams are emitted to the substrate 10 on the display side as indicated by the straight arrow mark in FIG. 2.

As explained above, the transparent electrode is a semiconductor layer having a conductivity which is relatively low as compared to the conductivity of the bus electrode 12 and, therefore, the metal bus electrode 12 is provided at the side end edge thereof. Therefore, even when conductivity of the transparent electrode 11 is a little lower than that of the metal bus electrode 12, resistance in the longitudinal direction of the X electrode 13X and the Y electrode 13Y is maintained at a value lower than that of the bus electrode.

However, in the dielectric layer forming process, which has been explained above, if the transparent electrode is damaged, such a damaged area of the transparent electrode requires a higher discharge voltage than that of the undamaged area and thereby achieving stable operation of the device as a whole becomes difficult.

Therefore, in a preferred embodiment of the present invention, in order to prevent a drop in the conductivity of the transparent electrode 11 caused by damage thereto, the main element, or component, of the composition of the bus electrode is included in the composition of the dielectric layer 14, which is in contact with and covers the bus electrode 12. For example, when the bus electrode 12 has a three-layer structure of chromium-copper-chromium, particles of copper oxide are mixed with the dielectric layer 14. Otherwise, copper oxide is doped into the composition of the glass of the dielectric layer 14. As a result, even after the subsequent high temperature baking process, the battery effect and oxidation-reduction reaction between the dielectric layer 14 and bus electrode 11 can be prevented and local losses of the transparent electrode can be avoided.

For example, when the copper oxide is mixed with the material of the dielectric layer, for a bus electrode 12 mainly composed of copper, the battery effect and oxidation-reduction reaction in the transparent electrode 11, bus electrode 12, and dielectric layer 14 can also be prevented. Namely, the battery effect and oxidation-reduction reaction, in which copper, which is the main element of the bus electrode, flows to the surface of the transparent electrode after the copper appears in the side of dielectric layer 14 by ionization, results in the reduction reaction of $In_2O_3$. The reduced In is further ionized and dissolves into the glass of dielectric layer 14 to form a hole, with the further reduction of In being controllable by adding, as a part of the glass, Cu and In to the glass material.

Figure 4:
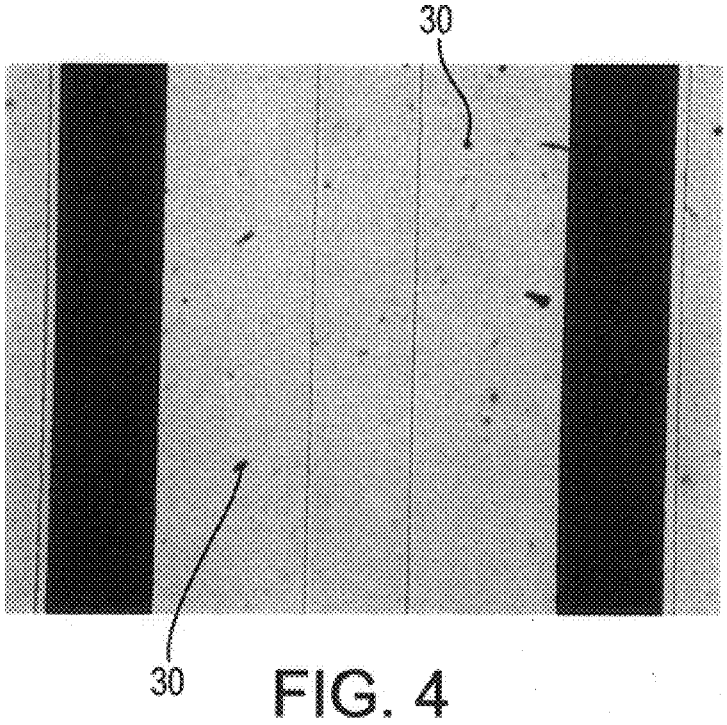
FIG. 4 is a diagram showing an observed result of the present invention wherein copper oxide is included in the dielectric layer of the PDP.
Figure 5:
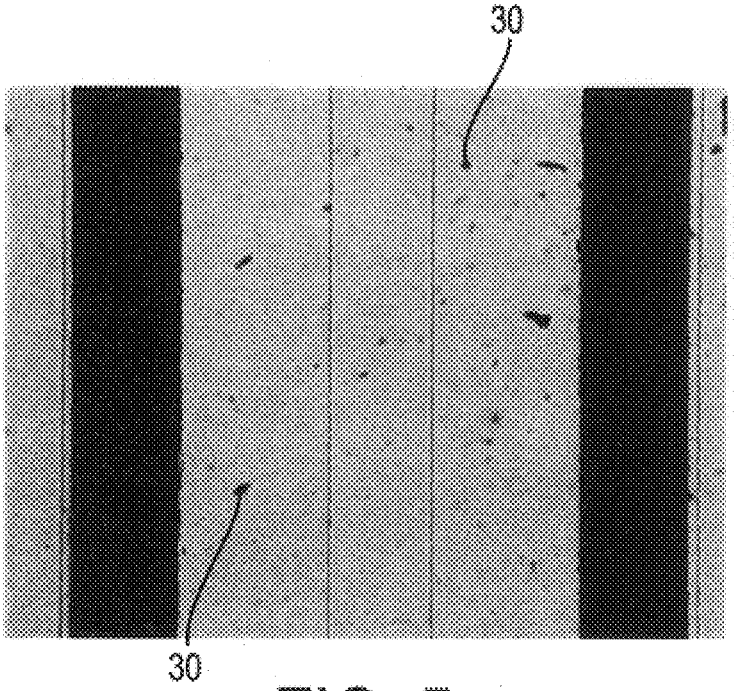
FIG. 5 is a diagram showing another observed result of the present invention wherein copper oxide is included in the dielectric layer of the PDP.
Figure 6:
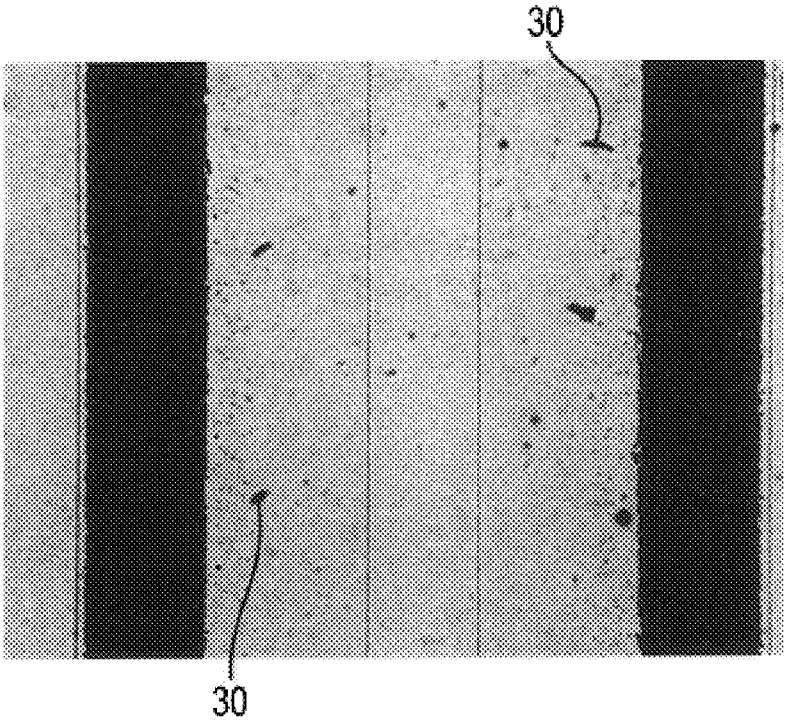
FIG. 6 is yet another diagram showing another observed result of the present invention wherein copper oxide is included in the dielectric layer of the PDP.
Figure 7:
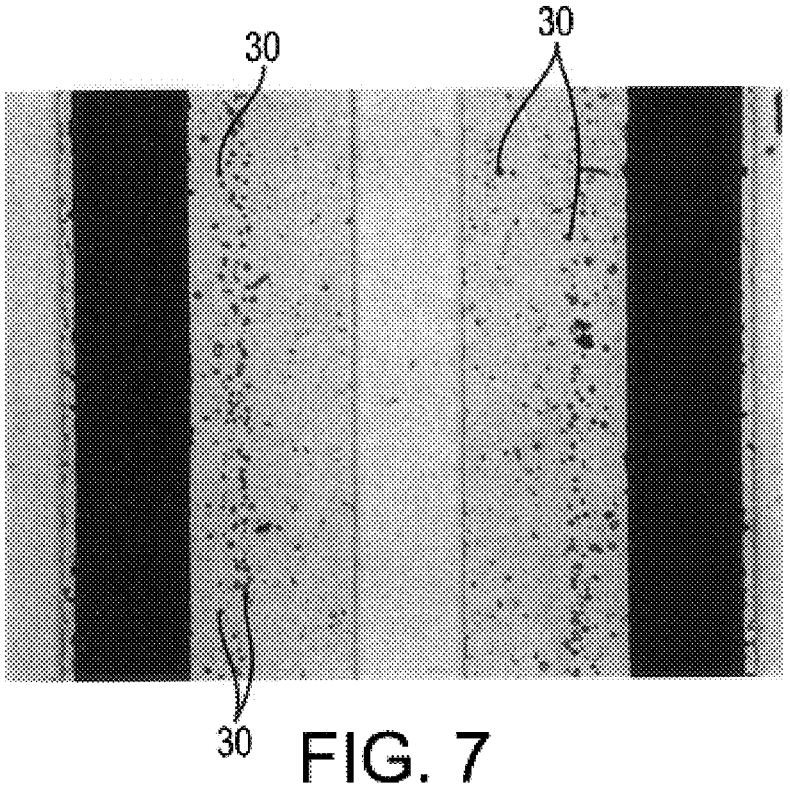
FIG. 7 is a diagram illustrating an observed result of the present invention wherein copper oxide is not included in the dielectric layer of the PDP.

FIGS. 4 to 7 illustrate observed results of the present invention where the transparent electrode 11 consists of ITO, the bus electrode 12 consists of chromium-copper-chromium, and the dielectric layer 14 already includes indium oxide, which is the main element of the transparent electrode, copper oxide is included in the dielectric layer 14. As an example, for the transparent electrode including ITO and tin oxide $SnO_2$, the dielectric layer includes indium oxide $In_2O_3$; and for the bus electrode consisting essentially of copper sandwiched by chromium, the dielectric layer contains copper oxide. The glass composition of the PbO—$SiO_2$—$B_2O_3$—ZnO—BaO group mixes with powdered indium oxide, which is the main element of the transparent electrode. Preferably, the dielectric layer contains between 0.1 and 3.0 wt % of copper. Even more preferably, the dielectric layer contains between 0.3 and 1.0 wt % of copper. Four samples of dielectric layers are depicted in the drawings:

Sample 1: copper oxide of 1.0 wt % is doped in a glass composition (FIG. 4);

Sample 2: copper oxide of 0.5 wt % is doped in a glass composition (FIG. 5);

Sample 3: copper oxide of 0.3 wt % is doped in a glass composition (FIG. 6); and Sample 4: copper oxide is not doped in the glass composition (FIG. 7).

In order to mix copper oxide particles into a glass material, copper oxide particles are mixed, in combination with adequate solvent and binder, with the glass powder to form a paste. Thereafter, the paste is screen-printed on the substrate and is then baked. It is required that the copper oxide particles be formed as small as possible in size so as to not shield the display beam, i.e. the light emitted by the phosphor layer.

Moreover, in order to realize the inclusion of copper oxide into the glass powder, copper oxide particles are mixed, for example, with the glass powder mainly composed of lead oxide. This mixture is then dissolved at temperatures as high as about 1300° C. Thus, copper oxide is included in the glass composition. Thereafter, the glass composition is cooled from the dissolved condition, which as noted above is as high as 1300° C., milled, and pasted together with solvent and binder. Thereafter, the glass composition is printed and baked. The baking temperature generally ranges from 580° C. to 600° C. The glass powder is dissolved by this process to form a dielectric layer.

As is apparent from FIG. 7, which shows a sample where the dielectric layer includes indium oxide, which is the main element of the composition of the transparent electrode but does not include copper oxide; after the high temperature baking process of the dielectric layer, the transparent electrode is locally lost and holes are generated as indicated by the black area given the numeral 30.

On the other hand, in FIGS. 4 though 6, where the dielectric material includes indium oxide which is the main element of the transparent electrode and also includes copper oxide, local losses of the transparent electrode can be controlled even after the high temperature baking process of the dielectric material. In FIG. 7, when copper oxide is not doped at all in the dielectric layer, a large number of fine holes of about 1 $\mu$m are generated as designated by reference numeral 30. Meanwhile, when copper oxide of 1.0 wt % is doped in the transparent electrode as shown in FIG. 4, losses of the transparent electrode, namely, the generation of holes is almost eliminated. Moreover, when copper oxide of 0.5 wt % is doped as shown in FIG. 5, the generation of holes is also practically eliminated. Even when copper oxide of 0.3 wt % is doped as shown in FIG. 6, the number of holes is reduced to ⅓ or less of the number shown in FIG. 7 where no copper is doped in the dielectric layer. This illustrates the control of losses in the transparent electrode. The above observations make it possible for one of ordinary skill in the art to understand that inclusion of a main element of the composition of a transparent electrode and a main element of the composition of the bus electrode in the dielectric layer 14, which is in contact with and covers the bus electrode 12, is effective in preventing local losses of the bus electrode or transparent electrode during high temperature processes such as the baking process.

Therefore, as a method of manufacturing a plasma display panel of the present invention, it is effective that the main element of the bus electrode, and better yet the main element of both the bus electrode and the transparent electrode, is included with glass paste on the occasion that the glass paste is printed to cover the transparent electrode and the bus electrode on the substrate on which they are formed. According to the methods of the present invention, the conductivity of the transparent electrode is never lowered even through the high temperature process for baking the glass paste and the subsequent high temperature process of sealing two sheets of glass substrate.

In the above preferred embodiment, the bus electrode material is mainly composed of copper oxide. However, the same effect can be expected when aluminum (Al), aluminum alloy (Al—Cu, Al—Cr, Al—Cu—Mn, etc.), cobalt (Co), silver (Ag), molybdenum (Mo), chromium (Cr), tantalum (Ta), tungsten (W) or iron (Fe) is used as the other substance.

As explained above, according to the preferred embodiment of the present invention, local losses of the transparent electrode can be prevented by including the main element of the composition of the bus electrode of the plasma display panel in the dielectric layer covering the bus electrode.

The present invention has been described in connection with what is presently considered to be the most practical and preferred embodiments of the present invention. However, the invention is not intended to be limited to the disclosed embodiments, but rather is intended to include all modifications and arrangements included within the spirit and scope of the appended claims.

What is claimed is:

1. A plasma display panel comprising:

a transparent electrode having a composition including a first element as a main element;

a bus electrode having a composition including a second element as a main element; and a dielectric layer covering said transparent and bus electrodes on at least one substrate of a pair of substrates positioned in opposed relationship and defining a discharge space therebetween, said dielectric layer having a composition including said second element.

2. A plasma display panel according to claim 1, wherein said bus electrode consists essentially of chronium-copper-chromium, and said dielectric layer composition includes copper oxide.

3. A plasma display panel according to claim 2, wherein a weight ratio of copper oxide in said dielectric layer is in the range of 0.1 to 3.0 wt %.

4. A plasma display panel according to claim 3, wherein a weight ratio of copper oxide in said dielectric layer is in the range of 0.3 to 1.0 wt %.

5. A plasma display panel according to claim 1, wherein said dielectric layer includes a low melting point glass.

6. A plasma display panel according to claim 5, wherein said low melting point glass is selected from the group consisting of lead oxide, bismuth oxide, and a phosphoric-acid based material.

7. A method of manufacturing a plasma display panel comprising a first substrate having formed thereon a plurality of transparent electrodes, a plurality of bus electrodes, and a dielectric layer covering said plurality of transparent electrodes and said plurality of bus electrodes and a second substrate positioned in opposed relationship to said first substrate and defining a discharge space therebetween, said method comprising:

forming a dielectric paste layer on said first substrate covering said plurality of transparent electrodes and said plurality of bus electrodes and having a composition including a main element of a composition of said bus electrodes and a main element of a composition of said transparent electrodes; and baking said first substrate with said dielectric paste layer thereon in a baking atmosphere to form said dielectric layer.

8. A method of manufacturing a plasma display panel according to claim 7, wherein said main element of said composition of said bus electrodes comprises copper.

9. A method of manufacturing a plasma display panel according to claim 7, wherein the step of forming said dielectric paste layer includes forming a powder paste by dissolving at a high temperature copper oxide powder, with copper being said main element of said bus electrode composition, and a low melting point glass powder as a dielectric material, and then milling said copper oxide powder and said low melting point glass powder.

10. A method of manufacturing a plasma display panel according to claim 7, wherein the step of forming said dielectric paste layer includes forming a powder paste by dissolving at a high temperature copper oxide powder, with copper being said main element of said bus electrode composition, indium oxide powder, with indium being said main element of said transparent electrode composition, and low melting point glass powder as a dielectric material and then milling said copper oxide powder, said indium oxide powder, and said low melting point glass powder.

11. A method of manufacturing a plasma display panel according to claim 7, wherein said step of forming said dielectric paste layer includes mixing particles of said main element of said composition of said bus electrode in a powder mixture.

12. A method of manufacturing a plasma display panel according to claim 7, wherein said step of forming said dielectric paste layer includes mixing particles of said main element of said bus electrode composition and particles of said main element of said transparent electrode composition.

13. A substrate structure of an AC type plasma display panel comprising, on a substrate surface, a transparent electrode formed of a transparent conductor, a bus electrode formed of a metal conductor partly overlapping said transparent electrode, and a dielectric layer covering said substrate surface in such a manner as to cover and be in contact with both said transparent electrode and said bus electrode, said dielectric layer having a composition comprising both a main element of a composition of said bus electrode and a main element of a composition of said transparent electrode in amounts sufficient to prevent diffusion of said bus electrode and said transparent electrode into said dielectric layer.

14. A substrate structure of an AC type plasma display panel according to claim 13, wherein said main element of said bus electrode composition is copper and said main element of said transparent electrode composition is indium oxide.

15. A plasma display panel comprising:

a pair of substrates opposed to one another and separated by a discharge space;

at least one bus electrode formed on one of said pair of substrates having a composition comprising a first element as a main element;

at least one transparent electrode covering said bus electrode and having a composition comprising a second element as a main element; and a dielectric layer formed on one of said substrates and covering said transparent and bus electrodes, said dielectric layer having a composition comprising at least said first element and said second element.

16. A plasma display panel according to claim 15, wherein said first element is selected from the group consisting of aluminum alloys, cobalt, silver, molybdenum, chromium, tantalum, tungsten, iron, and copper.

17. A plasma display panel according to claim 15, wherein said first element is copper and said dielectric layer composition includes copper oxide.

18. A plasma display panel according to claim 15, wherein said second element is indium and said dielectric layer composition includes indium oxide.

19. A plasma display panel according to claim 15, wherein said second element is indium and said dielectric composition layer includes indium oxide.

20. A plasma display panel according to claim 16, wherein said second element is indium and said dielectric layer composition includes indium oxide.

* * * * *

UNITED STATES PATENT AND TRADEMARK OFFICE

CERTIFICATE OF CORRECTION

PATENT NO. : 6,337,538 B1
DATED : January 8, 2002
INVENTOR(S) : Noriyuki Awaji et al.

It is certified that error appears in the above-identified patent and that said Letters Patent is hereby corrected as shown below:

Column 6,
Line 52, change “including” to -- comprising --.
Line 54, change “including” to -- comprising --.
Line 60, change “including” to -- comprising said first element and --.

Signed and Sealed this

Twenty-third Day of July, 2002

*Attest:*

*Attesting Officer*

JAMES E. ROGAN
*Director of the United States Patent and Trademark Office*